US007044211B2

(12) United States Patent
Insalaco

(10) Patent No.: US 7,044,211 B2
(45) Date of Patent: May 16, 2006

(54) METHOD OF FORMING HEAT EXCHANGER TUBING AND TUBING FORMED THEREBY

(75) Inventor: Jeffrey L. Insalaco, Cocoa Beach, FL (US)

(73) Assignee: Norsk Hydro A.S., Brussels (BE)

( * ) Notice: Subject to any disclaimer, the term of this patent is extended or adjusted under 35 U.S.C. 154(b) by 249 days.

(21) Appl. No.: 10/604,143

(22) Filed: Jun. 27, 2003

(65) Prior Publication Data

US 2004/0261986 A1 Dec. 30, 2004

(51) Int. Cl.
*F28F 1/16* (2006.01)

(52) U.S. Cl. ..... 165/183; 165/179

(58) Field of Classification Search ..... None
See application file for complete search history.

(56) References Cited

U.S. PATENT DOCUMENTS

| | | | | |
|---|---|---|---|---|
| 1,830,375 | A * | 11/1931 | Gertrude | 165/164 |
| 2,151,540 | A * | 3/1939 | Varga | 138/117 |
| 3,241,608 | A * | 3/1966 | Pauls | 165/177 |
| 3,457,756 | A * | 7/1969 | Rohde | 72/186 |
| 3,495,657 | A * | 2/1970 | Keith | 165/183 |
| 3,692,105 | A * | 9/1972 | O'Connor | 165/181 |
| 3,850,236 | A | 11/1974 | O'Connor et al. | 165/181 |
| 3,947,941 | A * | 4/1976 | O'Connor et al. | 72/324 |
| 4,298,062 | A * | 11/1981 | Pasternak | 165/181 |
| 4,926,933 | A | 5/1990 | Gray | 165/173 |
| 4,951,742 | A | 8/1990 | Keyes | 165/184 |
| 5,236,045 | A * | 8/1993 | Janezich et al. | 165/183 |
| 5,490,559 | A | 2/1996 | Dinulescu | 165/148 |
| 5,915,470 | A * | 6/1999 | Dierbeck | 165/144 |
| 6,173,493 | B1 * | 1/2001 | Dierbeck | 29/890.043 |
| 6,446,713 | B1 * | 9/2002 | Insalaco | 165/173 |
| 6,644,394 | B1 * | 11/2003 | Kraft et al. | 165/181 |
| 2001/0040025 | A1 * | 11/2001 | Jurisich | 165/148 |

FOREIGN PATENT DOCUMENTS

| | | | |
|---|---|---|---|
| JP | 60226696 | A * | 11/1985 |
| JP | 10325689 | A * | 12/1998 |
| WO | WO 9423257 | A1 * | 10/1994 |

* cited by examiner

*Primary Examiner*—Allen J. Flanigan
(74) *Attorney, Agent, or Firm*—Gary M. Hartman; Domenica N. S. Hartman; Hartman & Hartman

(57) ABSTRACT

A method of forming tubing with integral fins oriented parallel to its length, and to a heat exchanger tube produced by such a method. The invention involves extruding a tube so that the tube has at least one internal longitudinal passage, an external surface having a cross-sectional shape in a plane transverse to the extrusion direction, and at least one integral fin parallel to the extrusion direction and extending in a direction away from the external surface of the tube. The tube may be one of a plurality of tubes assembled in parallel to a pair of manifolds, and such tubes are preferably oriented so that their integral fins are substantially parallel, with the fin(s) of a given tube extending toward an adjacent one of the tubes.

14 Claims, 3 Drawing Sheets

METHOD OF FORMING HEAT EXCHANGER TUBING AND TUBING FORMED THEREBY

BACKGROUND OF INVENTION

1. Field of the Invention

The present invention generally relates to heat exchangers, such as those of the type used in air-conditioning systems. More particularly, this invention relates to a heat exchanger tube configuration that incorporates integral fins for transferring heat to and from the tube.

2. Description of the Related Art

Heat exchangers are employed within the automotive industry as condensers and evaporators for use in air conditioning systems, radiators for cooling engine coolant, heater cores for internal climate control, etc. One type of heat exchanger construction used in the automotive industry for condensers and evaporators comprises a number of parallel tubes that are joined to and between a pair of manifolds, creating a parallel flow arrangement. The ends of the tubes are typically metallurgically joined (brazed, soldered or welded) to tube ports, generally in the form of holes or slots formed in a wall of each manifold. In order to maximize the amount of surface area available for transferring heat between the environment and a fluid flowing through the heat exchanger, automotive heat exchangers often have a tube-and-fin construction in which numerous tubes thermally communicate with high surface area fins. The fins are typically in the form of flat panels having apertures through which tubes with circular cross-sections are inserted, or in the form of sinusoidal centers that are positioned between adjacent pairs of "flat" tubes with oblong cross-sections. In either case, the resulting tube-and-fin assembly is oriented so that the edges of the fins face the fluid (e.g., air) flowing between the tubes, i.e., the fins are normal to the plane defined by the tubes of the heat exchanger.

Alternative forms of fins have been suggested, examples of which include U.S. Pat. No. 4,546,819 to O'Connor, U.S. Pat. No. 4,951,742 to Keyes, and U.S. Pat. No. 5,353,868 to Abbott. Each of these patents discloses a cooling tube whose outer surface undergoes a second forming operation to have integral fins. Abbott discloses fin strips formed by lancing a conduit, while O'Connor and Keyes disclose integral fins formed by rolling the exterior of a tube. An approach to forming integral fins on round plastic tubing is taught in U.S. Pat. No. 4,926,933 to Gray, in which integral helical fins are defined on the exterior of a round plastic tube during injection molding or extrusion of the tube.

SUMMARY OF INVENTION

The present invention provides a method for forming tubing with integral fins, and to a heat exchanger tube produced by such a method. The method generally involves extruding the tube through a die so that the tube has at least one internal passage extending in a longitudinal direction parallel to the longitudinal direction in which the tube was extruded, an external surface having a cross-sectional shape in a plane transverse to the extrusion direction, and at least one integral fin parallel to the extrusion direction and extending in a direction away from the external surface of the tube. As such, the one or more fins are parallel to the longitudinal axis of the tube. The tube can be one of a plurality of identical tubes assembled in parallel to a pair of manifolds, and such tubes are preferably oriented so that their integral fins are substantially parallel, with the fin(s) of a given tube extending toward an adjacent one of the tubes. In this arrangement, the fins are oriented substantially parallel to the plane in which the tubes lie, contrary to conventional practice.

Significant advantages of the integral tube-and-fin construction of this invention include the elimination of separate fin stock and the costly manufacturing equipment associated with producing and brazing fins for heat exchanger tubing. Another feature of the invention is the potential for reducing the size of a heat exchanger for a given application as a result of the ability to more densely pack the tubes. Heat exchangers incorporating the integral tube-and-fin construction of this invention can find use in a variety of applications, including automotive and beverage cooling applications. For example, the integral tube-and-fin construction of this invention is suitable for use in conventional automotive cooling and air-conditioning units, as well as condensers and evaporators for $CO_2$-based air-conditioning systems. For beverage cooling applications, the integral tube-and-fin construction has the potential to exhibit improved water shedding characteristics and greater resistance to clogging by dirt, dust and other debris commonly encountered by beverage coolers.

Other objects and advantages of this invention will be better appreciated from the following detailed description.

DETAILED DESCRIPTION

Figure 1:
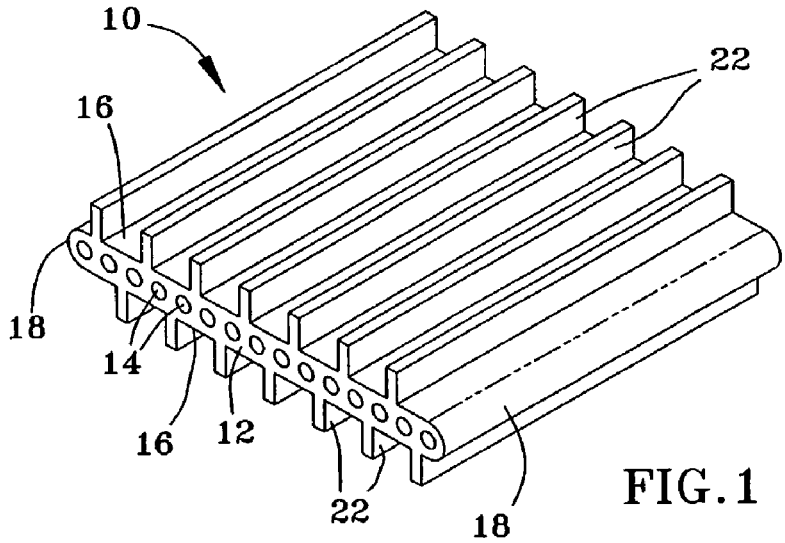
FIG. 1 is a perspective end view of an as-extruded tube with multiple integral fins in accordance with this invention.

FIG. 1 represents a segment of an as-extruded heat exchanger tube 10 configured in accordance with this invention. The tube 10 is represented as a flat (oblong cross-section) tube portion 12 with multiple internal passages 14 that extend in a longitudinal direction of the tube portion 12. According to a preferred aspect of the invention, the tube 10 is extruded and the passages 14 are formed during the extrusion process so as to be parallel to the extrusion direction of the tube 10. The external surface of the tube portion 12 is defined by oppositely-disposed flat surfaces 16 and two oppositely-disposed lateral surfaces 18. Multiple fins 22 extend from each of the flat surfaces 16 in a direction normal to the flat surfaces 16 and parallel to the extrusion direction. The fins 22 on one of the surfaces 16 are shown as being staggered relative to the fins 22 on the opposite surface 16, though such a configuration is not required.

As disclosed and defined herein, the fins 22 are "integral fins" with the tube portion 12 in that they are features formed of material continuous with the material that forms the tube portion 12, and not formed of material subsequently attached or otherwise added to the tube portion 12. In a preferred embodiment, the fins 22 are formed simultaneously with the tube portion 12, i.e., during the extrusion process, though integral fins 22 could also be defined following the operation by which the tube portion 12 is formed by deforming the surface of the tube portion 12 to create the fins 22.

Figure 2:
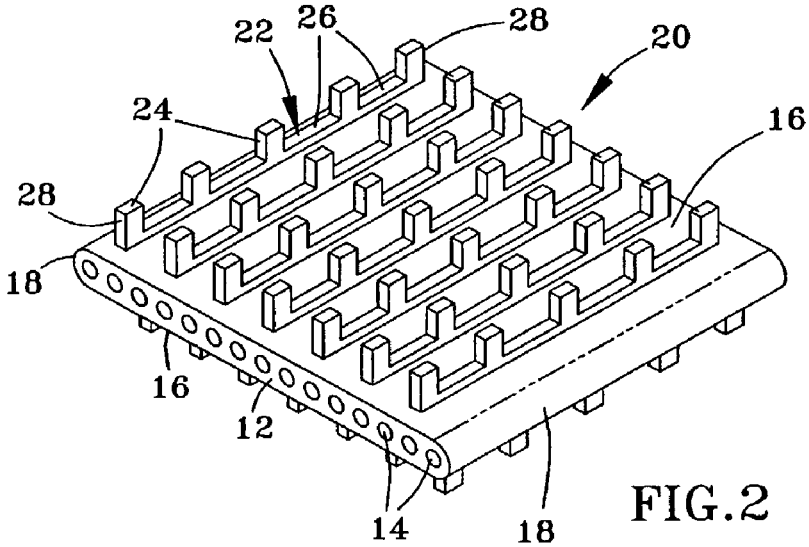
FIG. 2 is a perspective end view of the tube of FIG. 1 following a secondary operation in which portions of each fin are removed in accordance with an embodiment of the invention.
Figure 3:
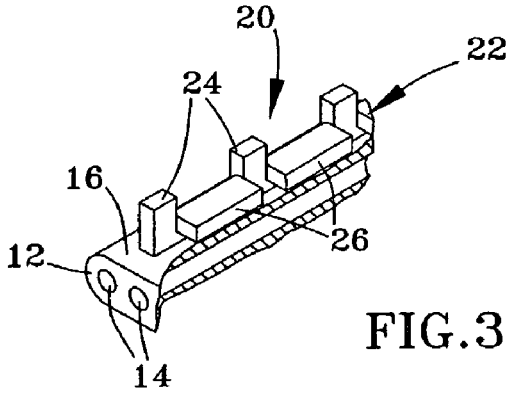
FIG. 3 is a perspective view of an alternative fin configuration formed by bending portions of each fin in a secondary operation.

FIGS. 2 and 3 depict, respectively, a tube 20 and a portion of a tube 20 formed by performing secondary operations on the tube 10 of FIG. 1. The tube 20 in FIG. 2 is depicted as having a relatively short length, though any length of tube is within the scope of this invention. In each case, the secondary operation has resulted in each fin 22 having alternating edge portions 24 and 26 along its length and terminal portions 28 spaced a longitudinal distance from each end of the tube portion 12. As depicted in FIGS. 2 and 3, the edge portions 24 extend a greater distance from the surfaces 16 of the tube portion 12 than the edge portions 26. In FIG. 2, the edge portions 26 are defined by the removal of rectangular sections from the edges of the fins 22, while in FIG. 3 the edge portions 26 are defined by bending over rectangular sections along the edges of the fins 22. In either case, the edge portions 26 define a longitudinal gap between adjacent edge portions 24, creating a profile similar to a square sawtooth. While the sections removed and bent in FIGS. 2 and 3, respectively, are rectangular in shape, various other shapes are possible.

Figure 4:
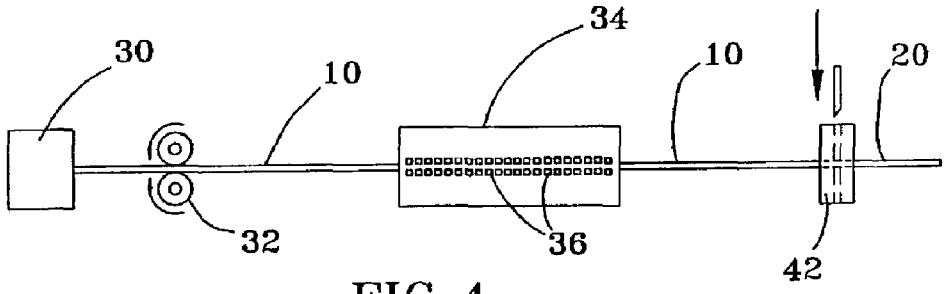
FIG. 4 schematically represents a process for forming the tube of FIG. 2.
Figure 5:
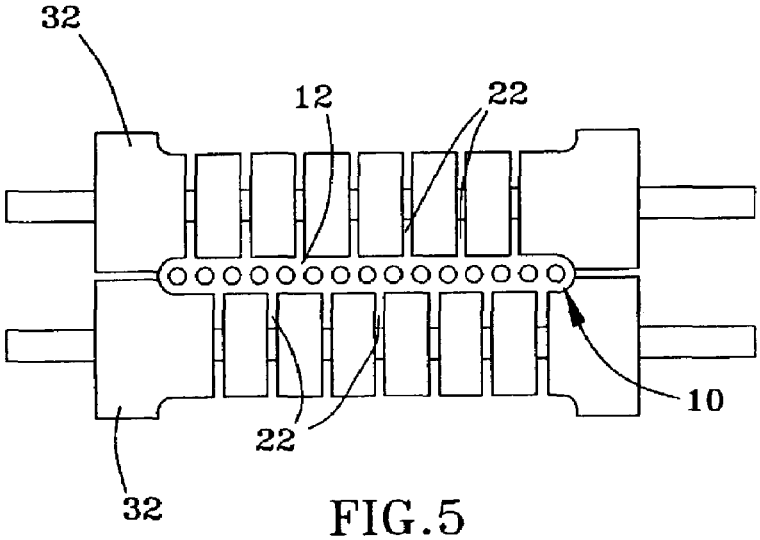
FIGS. 5 and 6 schematically represent individual steps of the forming process of FIG. 4.
Figure 6:
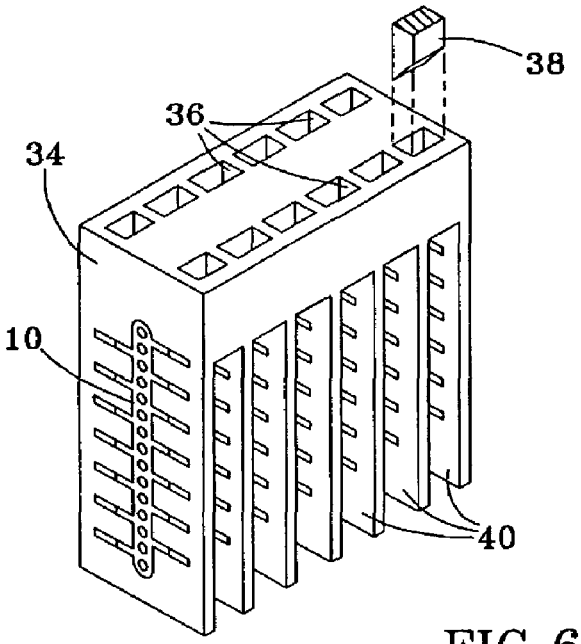

FIG. 4 schematically represents a process for forming the tube 10 of FIG. 1 and performing a skiving operation to form the tube 20 depicted in FIG. 2. The tube 10 is shown as being extruded with a die 30 having an appropriate shape to produce the desired integral tube-and-fin form shown in FIG. 1. Following extrusion, the tube 10 is passed through a pair of sizing rollers 32 before entering a skiving die 34, both of which are shown in more detail in FIGS. 5 and 6 respectively. The sizing rollers 32 are intended to improve the form and finish of the tube 10 following extrusion, and for this purpose include individual rollers that travel the flat surfaces 16 of the tube portion 12 between fins 22. The skiving die 34 is depicted as having multiple 36 into which skive punches 38 (only one of which is shown) are actuated to engage the fins 22 of the tube 10, thereby removing the rectangular sections to define the alternating shorter and longer edge portions 24 and 26 along the edges of the fins 22. To facilitate the skiving operation, the tube 10 is preferably fed from a separate source (e.g., a roll of the tube 10) instead of directly from the extrusion process, so that the tube 10 can be advanced into the skiving die 34 and then held stationary during the skiving operation. The skiving die 34 includes channels 40 that facilitate clearing of the rectangular sections removed from the fins 22. As an alternative to material removal, the skive punches 38 can be configured to deform the rectangular sections to produce the tube configuration shown in FIG. 3. After the skiving operation, the tube 10 continues on to a die 42 where individual tubes 20 are cut from the tube 10.

Figure 7:
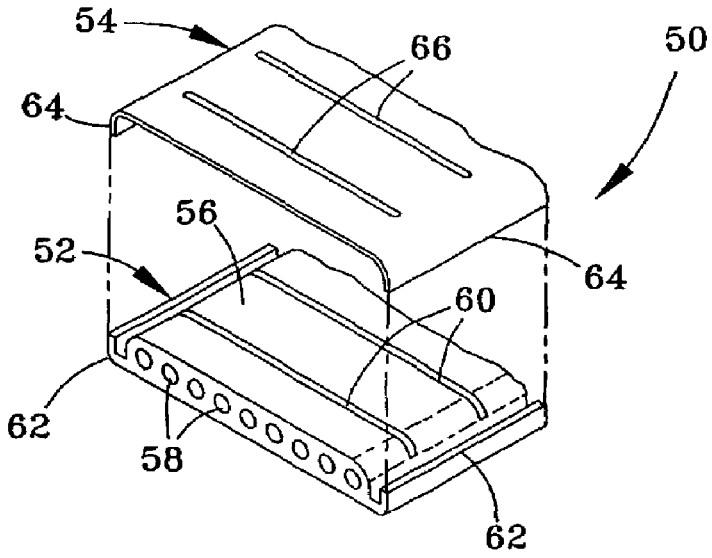
FIG. 7 is a perspective end view of a two-piece manifold for assembly with the tubes of FIGS. 1 through 3.

The tube 10 (and therefore the tubes 20) is preferably formed from a suitable aluminum alloy, though other alloys could be used. The tubes 20 are attached, such as by brazing or soldering, to a pair of manifolds so that the tubes 20 are fluidically connected to the manifolds to allow fluid flow to and from the manifolds. The manifolds can be of any suitable configuration for the intended application. FIG. 7 represents a particular embodiment for a manifold 50 suitable for assembly with the tubes 20 of this invention. The manifold 50 is shown to have a two-piece construction comprising a base profile 52 and a clad sheet 54, the latter of which carries a brazing material and preferably a flux coating (not shown) for brazing the tubes 20 and the clad sheet 54 to the profile 52. The base profile 52 is generally flat with a plurality of fluid passages 58, and therefore has a configuration similar to a flat heat exchanger tube, e.g., the tube portion 12 of the tubes 10 and 20 in FIGS. 1 through 3. Transverse slots 60 are machined in one wall 56 of the profile 52 to permit assembly of the tubes 20 with the profile 52 by inserting the ends of the tubes 20 into the slots 60. The base profile 52 includes oppositely-disposed tabs 62 for clinching the edges 64 of the sheet 54, by which the clad sheet 54 can be mechanically secured to the profile 52. The clad sheet 54 has openings 66 corresponding in size, shape and location to the slots 60 in the profile 52. In this manner, the clad sheet 54 can be mechanically secured to the profile 52 with the tabs 60 so that the openings 66 are aligned with the slots 60, and together the slots 60 and openings 66 define ports for the tubes 20.

Figure 8:
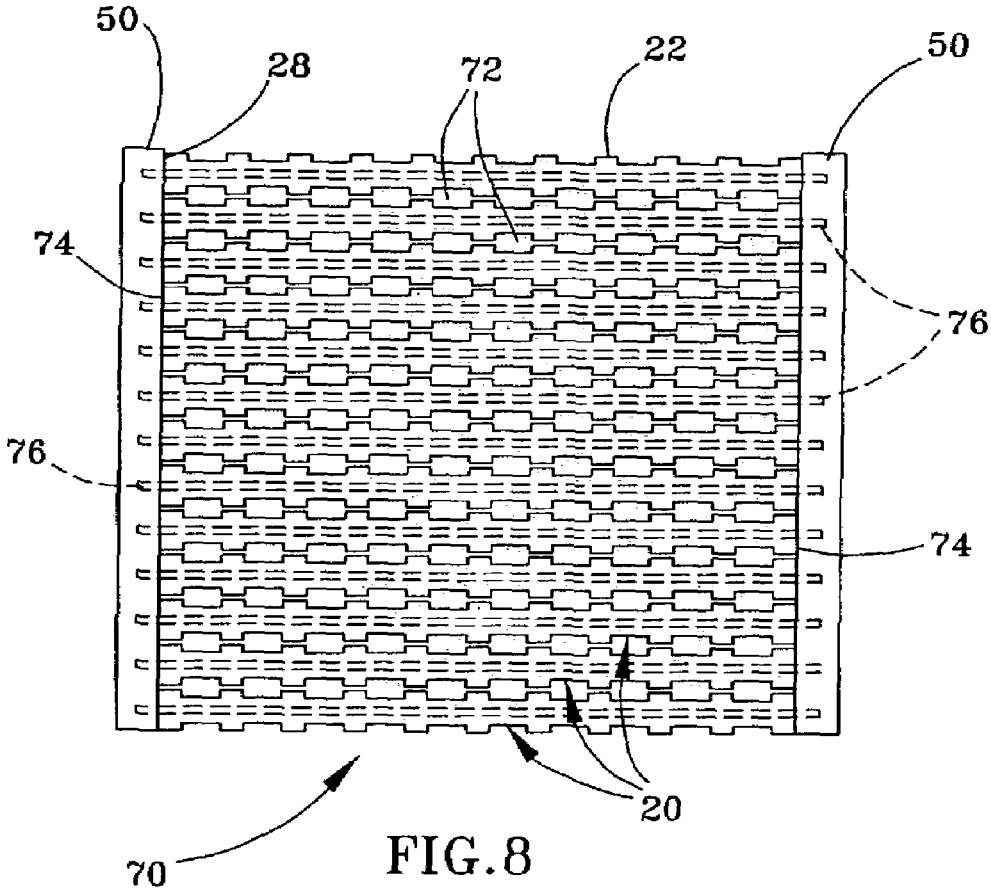
FIG. 8 is a frontal view of a heat exchanger comprising multiple tubes of the type shown in FIG. 2.

FIG. 8 depicts a heat exchanger 70 in which a number of the tubes 20 are assembled with a pair of manifolds 50 of the type depicted in FIG. 7. The ends of the tubes 20 are received in ports 76 in walls 74 of the manifolds 50. Based on the manifold construction of FIG. 7, the ports 76 are formed by the slots 60 and openings 66 in the profile 52 and cladding sheet 54, respectively, and the walls 74 of the manifolds 50 are formed by the joining of the cladding sheets 54 to the walls 56 of the profiles 52. As shown in FIG. 8, the terminal portions 28 of the fins 22 of each tube 20 abut the wall 74 of the manifolds 50, such that the terminal portions 28 advantageously serve as tube stops during the assembly process. The tubes 20 are oriented so that their flat surfaces 16 are normal to the plane defined by the tubes 20, with the result that the integral fins 22 of the tubes 20 are parallel to each other and to the plane defined by the tubes 20, and extend toward an adjacent tube 20. By spacing the longer portions 24 of each fin 22 a consistent distance apart, the longer and shorter portions 24 and 26 of the fins 22 can be aligned to create passages 72 within the heat exchanger 70 through which a fluid (e.g., air) flows for heat transfer with the tubes 20.

While the invention has been described in terms of particular embodiments, it is apparent that other forms could be adopted by one skilled in the art. For example, the processing steps could be modified, and materials and tube and manifold configurations other than those noted above could be adopted in order to yield a heat exchanger suitable for a wide variety of applications. Accordingly, the scope of the invention is to be limited only by the following claims.

The invention claimed is:

1. An extruded heat exchanger tube having at least one internal passage extending in a longitudinal direction parallel to an extrusion direction of the tube, an external surface having a cross-sectional shape in a plane transverse to the extrusion direction, and at least one integral fin having alternating first and second portions, the first portions extending a greater distance from the external surface of the tube than the second portions, the at least one integral fin and the first portion thereof being parallel to the internal passage and extending in a direction away from the external surface of the tube so that the orientation of the at least one integral fin relative to the tube enables co-extrusion of the tube and the at least one integral fin and the first portion thereof.

2. An extruded heat exchanger tube according to claim 1, wherein the external surface of the tube has two oppositely-disposed flat surfaces and two oppositely-disposed lateral surfaces, and the cross-sectional shape of the tube is oblong as a result of the flat surfaces having larger cross-sectional dimensions than the lateral surfaces.

3. An extruded heat exchanger tube according to claim 2, wherein the at least one integral fin comprises a plurality of integral fins, and all of the integral fins are present on the flat surfaces of the tube.

4. An extruded heat exchanger tube according to claim 1, wherein the at least one integral fin comprises a plurality of integral fins, the external surface of the tube comprises two oppositely-disposed flat surfaces, and all of the integral fins are present on the flat surfaces, oriented parallel to the internal passage, and extend away from the flat surfaces.

5. An extruded heat exchanger tube according to claim 1, wherein the second portions of the at least one integral fin are defined by bent regions of the at least one integral fin.

6. An extruded heat exchanger tube according to claim 1, wherein the second portions of the at least one integral fin are defined by removed regions of the at least one integral fin.

7. An extruded heat exchanger tube according to claim 1, wherein the at least one integral fin has a terminal portion a longitudinal distance from the end of the tube.

8. An extruded heat exchanger tube according to claim 7, wherein the tube is assembled with a manifold with the end of the tube residing in a port in a wall of the manifold and the terminal portion of the at least one integral fin abuts the wall of the manifold.

9. An extruded heat exchanger tube according to claim 8, wherein the tube is one of a plurality of extruded heat exchanger tubes assembled with the manifold, each tube having at least one internal passage extending in a longitudinal direction parallel to an extrusion direction of the tube, an external surface having a cross-sectional shape transverse to the extrusion direction, and at least one integral fin parallel to the extrusion direction and extending in a transverse direction away from the external surface of the tube, the at least one integral fin of each tube having alternating first and second portions, the first portions extending a greater distance from the external surface of the tube than the second portions, the first portions being aligned with each other so that passages between the tubes are defined by the second portions.

10. An extruded heat exchanger tube according to claim 8, wherein the manifold is formed to have an external surface with an oblong cross-sectional shape and two oppositely-disposed flat surfaces, one of the flat surfaces defining the wall of the manifold in which the port is present.

11. A heat exchanger having a pair of manifolds and extruded tubes fluidically connected to the manifolds to allow fluid flow to and from the manifolds through the tubes, each of the tubes comprising:

multiple internal passages extending in a longitudinal direction parallel to an extrusion direction of the tube;

an external surface having an oblong cross-sectional shape defined by oppositely-disposed flat surfaces and two oppositely-disposed lateral surfaces; and multiple integral fins on the flat surfaces, parallel to the extrusion direction, and extending in directions normal to the flat surfaces of the tube, each of the integral fins having alternating first and second portions and oppositely-disposed terminal portions spaced longitudinal distances from oppositely-disposed ends of the tube, the first portions extending a greater distance from the flat surfaces of the tube than the second portions;

wherein the tubes are assembled with the manifolds with the ends of the tubes residing in ports in walls of the manifolds and the terminal portions of the integral fins abutting the walls of the manifolds, the tubes being oriented so that the integral fins of adjacent pairs of the tubes are substantially parallel and the integral fins of each of the tubes extend toward an adjacent one of the tubes.

12. A heat exchanger according to claim 11, wherein the integral fins are present exclusively on the flat surfaces of the tubes.

13. A heat exchanger according to claim 11, wherein the second portions of the integral fins are defined by bent regions of the integral fins.

14. A heat exchanger according to claim 11, wherein the second portions of the integral fins are defined by removed regions of the integral fins.

* * * * *